US006524353B2

(12) United States Patent
de Rosa et al.

(10) Patent No.: US 6,524,353 B2
(45) Date of Patent: Feb. 25, 2003

(54) METHOD OF ENHANCING THE LOW TEMPERATURE SOLUTION PROPERTIES OF A GASOLINE FRICTION MODIFIER

(75) Inventors: Thomas F. de Rosa, Beacon, NY (US); Benjamin J. Kaufman, Beacon, NY (US); Frank J. DeBlase, Beacon, NY (US); James R. Ketcham, Beacon, NY (US); Michael G. Rawdon, Beacon, NY (US); Max R. Cesar, Beacon, NY (US)

(73) Assignee: Texaco Development Corporation, White Plains, NY (US)

( * ) Notice: Subject to any disclaimer, the term of this patent is extended or adjusted under 35 U.S.C. 154(b) by 0 days.

(21) Appl. No.: 09/728,405

(22) Filed: Dec. 1, 2000

(65) Prior Publication Data

US 2002/0134007 A1 Sep. 26, 2002

Related U.S. Application Data

(60) Provisional application No. 60/230,765, filed on Sep. 7, 2000.

(51) Int. Cl.[7] ..... C10L 1/18; C10L 1/22

(52) U.S. Cl. ..... 44/418; 554/35; 554/61; 554/63

(58) Field of Search ..... 44/418, 386; 554/35.61, 554/63

(56) References Cited

U.S. PATENT DOCUMENTS

| | | | | | |
|---|---|---|---|---|---|
| 4,297,107 | A | * | 10/1981 | Boehmke | 44/301 |
| 4,428,754 | A | * | 1/1984 | Smith | 44/418 |
| 4,729,769 | A | | 3/1988 | Schlicht et al. | |
| 5,366,518 | A | | 11/1994 | DeRosa et al. | |
| 5,558,684 | A | | 9/1996 | DeRosa et al. | |
| 5,558,685 | A | | 9/1996 | DeRosa et al. | |
| 5,567,211 | A | | 10/1996 | Russo et al. | |
| 5,891,203 | A | * | 4/1999 | Ball | 44/388 |

FOREIGN PATENT DOCUMENTS

| | | | |
|---|---|---|---|
| DE | 19827304 | * | 2/1999 |

* cited by examiner

*Primary Examiner*—Cephia D. Toomer
(74) *Attorney, Agent, or Firm*—Reed Smith LLP

(57) ABSTRACT

A fuel additive composition composed of the reaction product of (a) mixed fatty acid esters; (b) a mono or di-(hydroxy alkyl amine) or mixtures thereof; and (c) a low temperature property enhancing effective amount of a low molecular weight ester; wherein the reaction mixture has a molar ratio of amine to total ester content in the range from 10.0 to 1.0. The fuel additive exhibits detergent and friction reducing properties when added to a fuel thereto and further exhibits good low temperature stability properties. Methods for making the inventive composition and fuel compositions containing the additive are also disclosed.

40 Claims, No Drawings

METHOD OF ENHANCING THE LOW TEMPERATURE SOLUTION PROPERTIES OF A GASOLINE FRICTION MODIFIER

CROSS REFERENCE TO RELATED APPLICATIONS

This application is a regular patent application of U.S. Provisional Patent Application Ser. No. 60/230,765, filed on Sep. 7, 2000.

BACKGROUND OF THE INVENTION

1. Field of Invention

The invention relates to an engine fuel additive and fuels containing the inventive additive. This additive is characterized in that it exhibits improved low temperature solution properties as well as improving fuel economy.

2. Background of the Invention

Government legislated fuel economy standards have resulted in efforts being made by both automotive and additive suppliers to enhance the fuel economy of motor vehicles. One approach to achieve greater fuel efficiency is by lubricant formulation. Fuel consumption can be reduced either by decreasing the crank case oil viscosity or by reducing friction at specific, strategic areas of an engine. For example, inside an engine, about 18% of the fuel's heat value is dissipated through internal friction (bearings, valve train, pistons, rings, water and oil pumps) while only about 25% is actually converted to (useful) work at the crankshaft. The piston rings and part of the valve train account for over 50% of the friction and operate at least part of the time in the boundary lubrication mode during which a friction modifier (FM) may be effective. If a friction modifier reduces friction of these components by a third, the friction reduction corresponds to about a 3.0% improvement in the use of the fuel's heat of combustion and will be reflected in a corresponding fuel economy improvement.

A chemical additive designed to improve engine fuel economy is disclosed in U.S. Pat. No. 4,729,769, the contents of which are hereby incorporated by reference. This Patent discloses an additive which is obtained by the reaction of a $C_6$–$C_{20}$ fatty acid ester and a mono- or di-hydroxy hydrocarbon amine. Specifically, the additive is obtained by the reaction of 0.8 moles of coconut oil with 1.44 moles of diethanolamine (representing a molar ratio of coconut oil to diethanolamine of 0.555) by heating it at 120° C. to 150° C. for between 2 and 4 hours. Fuel economy is improved when this reaction product mixture is used as a gasoline or diesel fuel additive.

However, the limited temperature solution stability of this product is not as advantageous as desired. Thus, a problem encountered with such additives is due to their poor low temperature stability. Such additives are typically produced at a chemical plant which is remote from the petroleum terminal where the additive is blended with the fuel, e.g., gasoline or diesel fuel, prior to delivery to service stations. The additive must therefore be shipped from the manufacturing facility to a terminal by tank, truck or rail car. Once the additive arrives at the terminal, it is typically stored in a tank from which it is pumped and blended with gasoline stocks. The duration of shipment and storage of the additive can last several days to a year during which time the temperature of the fuel can reach very low temperatures, e.g., 10° F. or lower. It has been observed that prior art additives often precipitate or produce a flocculent sediment while stored at such low temperatures. This instability at lower temperatures is highly adverse to the quality and efficiency of the additive and thus impairs the ability to use the additive.

SUMMARY OF THE INVENTION

We have discovered a novel fuel additive which exhibits substantially improved low temperature solution properties and yet performs at least as well as presently known friction modifier additives.

More particularly, we have discovered that the foregoing improvements can be Achieved by utilizing as a fuel additive, a composition comprising the reaction product of a reaction mixture composed of:

a) mixed fatty acid esters;

b) a mono or di-(hydroxy alkyl amine) or mixtures thereof; and c) a low temperature property enhancing effective amount of a low molecular weight ester;

wherein the reaction mixture has a molar ratio of amine to total ester content in the range from 10.0 to 1.0.

In addition, we have found that the inventive composition is obtained by heating:

a) mixed fatty acid esters;

b) a mono or di-(hydroxy alkyl amine) or mixtures thereof; and c) a low temperature property enhancing effective amount of a low molecular weight ester;

The amounts of each component and the temperature and the time period of heating being sufficient to produce an amide to ester absorbance ratio in the composition of at least 2.0 as measured by transmission infrared spectroscopy.

DESCRIPTION OF THE PREFERRED EMBODIMENT

The first component used to produce the inventive composition may be a mixed ester of fatty acids containing 6 to 20, preferably 8 to16 carbon atoms. These acids may be characterized by the formula RCOOH wherein R is an alkyl hydrocarbon group containing 7–15, and preferably 11–13 carbon atoms.

The mixed ester may be a tri-ester, such as, a glycerol tri-ester of structural formula I:

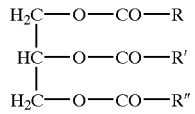

(I)

wherein R, R', and R" are mixtures of aliphatic, olefins, or polyolefins.

Typical of the mixed fatty acid esters which may be employed may be the following:

glyceryl tri-laurate
glyceryl tri-stearate
glyceryl tri-palmitate
glyceryl di-laurate
glyceryl mono-stearate
ethylene glycol di-laurate
pentaerythritol tetra-stearate
pentaerythritol tri-laurate
sorbitol mono-palmitate
sorbitol penta-stearate propylene glycol mono-stearate These esters may include those wherein the acid moiety is a mixture such as is found in natural oils typified by the following oils:

Coconut

Babassu

Palm kernel

Palm

Olive

Caster

Peanut

Rape

Beef Tallow

Lard (leaf)

Lard Oil

Whale blubber

The preferred mixed ester is coconut oil which contains the acid moieties summarized Tables 1 and 2.

TABLE 1

Saturated acid components of coconut oil

| Acid | Chemical Name | Content (mol %) |
|---|---|---|
| Caproic | Hexanoic Acid | 0.5 |
| Caprylic | Octanoic Acid | 7.1 |
| Capric | Decanoic Acid | 6.0 |
| Lauric | Dodecanoic Acid | 47.1 |
| Myristic | Tetradecanoic Acid | 18.5 |
| Palmitic | Hexadecanoic Acid | 9.1 |
| Margaric | Heptadecanoic Acid | 0 |
| Stearic | Octadecanoic Acid | 2.8 |
| Arachidi | Eicosanic Acid | 0.1 |
| Behenic | Behenic Acid | 0 |

TABLE 2

Mono- and poly-unsaturated acid components of coconut oil.

| Acid | Chemical Name | Double Bonds | Content (mol %) |
|---|---|---|---|
| Palmitoleic | cis-9-hexadecenoic Acid | 1 | 0 |
| Oleic | cis-9-octadecenoic Acid | 1 | 6.8 |
| Linolenic | Linolenic Acid | 3 | 1.9 |
| Linoleic | Linoleic Acid | 2 | 0.1 |

The second component used to produce the inventive composition may be a primary or a secondary amine which possesses a hydroxy group characterized by formula II:

$$HN(R'''OH)_{2-a}H_a \quad \text{(II)}$$

wherein R''' is a divalent alkylene hydrocarbon group containing 1–10 carbon atoms, and a is 0 or 1.

Typically amines may include ethanolamine, diethanolamine, propanolamine, isopropanolamine, dipropanolamine, di-isopropanolamine, butanolamines, and the like. Preferred is diethanolamine, CAS Number (111-42-2) which is a basic alkanolamine containing reactive appendages at each of its three termini. Its structural formula is shown as (III).

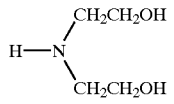

(III)

Diethanolamine (DEA)

The third component used to produce the inventive composition is a low molecular weight ester which imparts the enhanced low temperature properties of the resultant composition. The low molecular weight ester has an acid moiety represented by the formula:

R""CO— wherein R"" is an alkyl or alkenol hydrocarbon group containing from about 3 to 10 carbon atoms. Preferably, the acid moiety of the low molecular weight ester is selected from the group consisting of aprylic, caproic, capric and mixtures thereof. Most preferably, the low molecular weight ester is methyl caprylate, also known as methyl octanoate, CAS Number (111-11-5). It is the ester obtained from the reaction of octanoic acid and methyl alcohol and has the structural formula depicted as IV:

$$CH_3(CH_2)_5COCH_3 \quad \text{(IV)}$$

Methyl Caprylate

Preferably the inventive composition is prepared from a reaction mixture in which the molar ratio of amine to total ester is in the range from about 8.0 to 2.0. The amide to ester absorbance ratio of the inventive composition is in the range from at least about 2 as measured by transmission infrared spectroscopy.

The mixture is heated for a time period of about from 0.5 to 10.0 hours and at a temperature at from about 60° C. to about 250° C. to produce the inventive composition which exhibits enhanced properties. Typically, the mixture is heated at a temperature of from about 60° C. to about 200° C. for a time period of from about 0.5 to 10 hours. Preferably, the mixture is heated for a time period of from about 1.5 to about 6.0 hours, and most preferably at a temperature in the range from about 110° C. to about 180° C.

A preferred reaction mixture is composed of from about 0.1 to about 0.8 moles of the mixed fatty acid ester, from about 1.0 to about 4.5 moles of the amine and from about 0.01 to about 0.60 moles of the low molecular weight ester. Most preferably, in the reaction mixture, the amount of fatty acid ester mixture is in the range of from about 0.5 to 0.8 moles, the amount of the low molecular weight ester is in the rage of from about 0.1 to about 0.5 moles, and the amount of the amine is in the range of from about 1.2 to about 3.2 moles.

In the final fuel additive composition, the molar ratio of the amine to total ester content is in the range of from about 5.0 to 2.2, wherein the term "total ester content" means the combined molar amounts of the mixed fatty acid ester and the low molecular weight ester.

When added to a fuel, the inventive composition exhibits friction modifying and detergent properties at least as good as those exhibited by prior art compositions, such as the composition exemplified in U.S. Pat. No. 4,729,769. However, in addition, it exhibits improved stability at low temperatures, such as, those temperatures that may be encountered during shipping of the composition.

When used in a fuel composition, the base fuel in which the inventive fuel additive composition may be used may be a motor fuel composition composed of a mixture of hydrocarbons boiling in the gasoline boiling range or the diesel fuel boiling range. This base fuel may contain straight chain or branch chain paraffins, cycloparaffins, olefins and aromatic hydrocarbons as well as mixtures of these. The base fuel may be derived from straight-chained naptha, polymer gasoline, natural gasoline, catalytically cracked or thermally cracked hydrocarbons as well as catalytically reformed stocks. It may typically boil in the range of about 80° to 450° F. and any conventional motor fuel base may be employed in the practice of the invention.

The fuel composition of the invention may also contain any of the additives normally employed in a motor fuel. For example, the base fuel may be blended with anti-knock compounds, such as tetraalkyl lead compounds, including tetraethyl lead, tetramethyl lead, tetrabutyl lead, and/or cyclopentadienyl manganese tricarbonyl, generally in a concentration from about 0.05 to 4.0 cc. per gallon of gasoline. The tetraethyl lead mixture which is commercially available for automotive use contains an ethylene chloride-ethylene bromide mixture as a scavenger for removing lead from the combustion chamber in the form of a volatile lead halide. The motor fuel composition may also be fortified with any of the conventional additives including anti-icing additives, corrosion-inhibitors, dyes, etc.

The fuel additive composition may be added to the base fuel in minor amounts sufficient or effective to produce a detergent and friction reducing property to the mixture. The additive is particularly effective in an amount of about 0.002 to 0.2 wt. % (ca. 0.6 to 64 PTB) (PTB stands for pounds per thousand barrels). The preferred range is from about 0.008 to 0.1 wt. % (ca. 2.7 to 34 PTB), and most preferably, about 0.02 to 0.08 wt. % (ca. 6.4 to 27 PTB). (All wt. % is based on the total weight of the fuel composition.

Experimental Section.

EXAMPLE 1

Friction modifiers were prepared in accordance with the present invention and the method of Schlicht et al as set forth in U.S. Pat. No. 4,729,769. Specifically, for the present invention, 0.7 mole of coconut oil and 0.3 mole of methyl caprylate were mixed and reacted with 2.50 moles of diethanolamine by heating at 150° C. for three hours. For the method of U.S. Pat. No. 4,729,769, 1.0 mole of coconut oil and 1.8 mole of diethanolamine amine diethanolamine (representing a molar ratio of coconut oil to diethanolamine of 0.555) were reacted together at a temperature from 130° C. and 150° C. for about 2 to 4 hours. A reference composition was prepared from coconut oil and soybean oil for comparison purposes.

Preparation of the Condensation Product of the Present Invention.

At ambient temperature, a 1-liter 3-neck glass round bottom flask containing a thermometer, condenser with a nitrogen egress tube, a mechanical stirrer with a 2 inch teflon propeller, was charged with 157.5 g (2.5 mole) of diethanolamine, 276.36 g (0.7 mole) of coconut oil (Cochin) and 28.44 g (0.3 mole) methyl caprylate. The mixture was nitrogen sparged for 10 minutes and then heated to a reaction temperature of 150° C. in 1 hour and 20 minutes. The temperature was maintained at 150° C. for approximately 3 hours. The extent of the reaction was monitored by analyzing aliquots of the reaction mixture for the amide:ester ratio using infrared spectroscopy. Once the desired amide:ester ratio was achieved, heat was removed and the mixture allowed to cool to ambient temperature over a period of 2.0 hours. After cooling to 25° C., the amide:ester ratio was re-measured since it moderately increases. A typical total reaction time from charging the kettle to obtaining cooled product is approximately 4.5 hours.

Product Analysis.

Transmission Method Monitoring Product by Infrared Spectroscopy Method.

Scope

The product performance and low temperature properties are affected by the concentration of amide-to-ester ratio. In order to optimize material performance, an amide-to-ester absorbance ratio range of at least 2.0 at the end of the reaction as measured by Transmission IR, must be achieved. As noted, this ratio increases somewhat with time after the end of the reaction procedure. However, it is important that at the very end of the reaction, it be at least about 2.0. Accordingly, the progress for the reaction is monitored as detailed below.:

Procedure for monitoring the reaction.

Transmission Infrared spectroscopy is to measure a thin smear of a sample of the reaction mixture between two NaCl transmission windows 1) Run absorbance sample at 25° C. at 8 $cm^{-1}$ resolution or better
2) Baseline correct the spectrum at 1900 $cm^{-1}$
3) Measure the absorbance at 1621.5 $cm^{-1}$
4) Measure the absorbance at 1739.7 $cm^{-1}$ and then calculate the absorbance ratio as Abs (1621.5 $cm^{-1}$)/Abs (1739.7 $cm^{-1}$)
5) Once the amide-to-ester ratio is at least about 2.0–5.0 the reaction should be cooled
6) When the reaction is cooled to ambient temperature re-measure the absorbance ratio of the reaction since it will slightly increase. If, however, the ratio decreases, the reaction went too far and ester is being made.

Material Testing.

Part I Lubricity Testing of Experimental Friction Modifiers

Lubricity testing of Experimental Friction Modifiers was performed using a modified High Frequency Reciprocating Rig (HFRR) method described in ASTM method D 6079-97. The modification was that a gasoline fuel was evaluated at a temperature of 25° C. Wear Scar Diameter (WSD) of Experimental Friction Modifiers is calculated using Equation (I):

$$WSD=(M+N)/2 \quad \text{Eq. (I)}$$

WSD=wear scar diameter, mm

M=Major Axis, mm

N=Minor Axis

HFRR test results are summarized in Table 3.

TABLE 3

HFRR test results conducted at 25 deg C. for Experimental Modifiers and Reference Materials using gasoline fuel.

| Friction Modifier | Ester Composition | Fuel Treatment (ppm) | Scar Diameter (mm) | Notes |
|---|---|---|---|---|
| Reference-3 | 75 mole % coconut oil 25 mole % soybean oil | 100 | 0.356 | Schlicht analogue with good low temp solution properties |
| Schlicht Product | 100 mole % coconut oil | 100 | 0.366 | Prepared using Schlicht method |
| Inventive Product | 0.7 mole % coconut oil and 0.3 mole % Methyl caprylate | 60 | 0.332 | Prepared using 2.5 moles DEA |

Part II Low Temperature Solution Properties of Experimental Friction Modifiers.

Low temperature solution properties of the Experimental Friction Modifier were determined at −10, −15, and −20° C. using a 50 wt % sample concentrate in Aromatic-100 solvent. The samples were kept at the temperatures and for the time periods indicated in Tables 4, 5, and 6. The samples were then evaluated by visual inspection as to whether they were clear, slightly hazy, hazy or contained a precipitate. The desired result is that the samples remain clear which means that the additive remains soluble.

Low temperature solution test results at −10, −15, and −20 deg C. are summarized in Tables 4, 5, and 6, respectively.

TABLE 4

Solution properties for Experimental Friction Modifiers at −10° C.

| 50 wt % Friction Modifier in Aromatic-100 | Day-4 | Day-8 | Day-12 |
|---|---|---|---|
| Reference-3 | Soluble | Soluble | Hazy |
| Schlicht Product | Ppt. | Ppt. | Ppt. |
| Inventive Product | Soluble | Soluble | Soluble |

TABLE 5

Solution properties for Experimental Friction Modifiers at −15° C.

| 50 wt % Friction Modifier in Aromatic-100 | Day-3 | Day-6 | Day-9 |
|---|---|---|---|
| Reference-3 | Soluble | Slightly Hazy | Hazy |
| Schlicht Product | Ppt. | Ppt. | Ppt. |
| Inventive Product | Soluble | Soluble | Soluble |

TABLE 6

Solution properties for Experimental Friction Modifiers at −20° C.

| 50 wt % Friction Modifier in Aromatic-100 | Day-2 | Day-4 | Day-6 |
|---|---|---|---|
| Reference-3 | Soluble | Hazy | HPpt. |
| Schlicht Product | Ppt. | Ppt. | Ppt. |

TABLE 6-continued

Solution properties for Experimental Friction Modifiers at −20° C.

| 50 wt % Friction Modifier in Aromatic-100 | Day-2 | Day-4 | Day-6 |
|---|---|---|---|
| Inventive Product | Soluble | Soluble | Soluble |

Part III Engine Testing Experimental Friction Modifiers.

The purpose of engine testing was to determine the effect upon engine cleanliness from fuel additized with experimental friction modifiers. The Honda Generator engine was used as the test engine.

Test Description.

The Honda Generator was developed to evaluate the effect of additives on intake valve deposits and their ability to prevent intake valves from sticking.

The Honda Generator consists of a 4-stroke, overhead cam, 2-cylinder water cooled engine. The Honda Generator Test is run for 80 hours at which point the cylinder head, cam shaft, intake valve keepers, springs and valve guide seals are disassembled. The intake valves are disturbed as little as possible. The cylinder head with intake valves in place is placed into a freezer at approximately 2 deg F for a period of 12–24 hours. The amount of force in pounds to push open the valve is then determined. In addition, the intake system is then rated.

To ascertain the effects these friction modifiers had upon engine cleanliness, each friction modifier was added to base fuel with a commercial fuel detergent. Table 7 summarizes Honda Generator Testing.

TABLE 7

Summary of Honda Generator Engine Testing using fuel additized with friction modifier prepared according to Schlicht et al and as prepared in this Application.

| Friction Modifier | Detergent (PTB) | Friction Modifier (PTB) | Intake Valve Rating (a) | Deposit Weight (mg) | Valve Stickiness |
|---|---|---|---|---|---|
| Base Fuel | 0 | 0 | 6.3 | 429 | Moderate Push |
| Base Fuel | 100 | 0 | 9.7 | 3 | Light Push |
| Schlicht Product | 100 | 52 | 9.3 | 102 | Light Push |
| Inventive Product | 100 | 52 | 9.3 | 81 | Light Push |

(a) is a visual numerical rating of the intake valve deposition between 10 and 0 wherein 10 indicates a deposit free intake valve and 0 indicates extremely excessive deposition on the intake valve.

We claim:

1. A fuel additive composition comprising the reaction product of a mixture of:

a) mixed fatty acid esters selected from the group consisting of tri-esters of fatty acids containing from about 6 to 20 carbon atoms;

b) a mono or di-(hydroxy alkyl amine) or mixtures thereof; and c) a low temperature property enhancing effective amount of a low molecular weight ester having an acid moiety represented by the formula:

R""CO— wherein R"" is an alkyl or alkenyl hydrocarbon group containing from about 3 to 10 carbon atoms.

2. The composition of claim 1 wherein the mixed fatty acid ester comprise a glycerol tri-ester.

3. The composition of claim 1 wherein the mixed fatty acid esters are selected from the group consisting babassu oil, palm kernel oil, palm oil, olive oil, castor oil, peanut oil, rape oil, beef tallow oil, lard oil, whale blubber oil and sunflower oil.

4. The composition of claim 1, wherein the amine has the following formula:

$$HN(R'''OH)_{2-a}H_a$$

wherein R''' is a divalent alkylene hydrocarbon group containing 1–10 carbon atoms, and a is 0 or 1.

5. The composition of claim 4 wherein the amine is selected from the group consisting of ethanolamine, diethanolamine, propanolamine, isopropanolamine, dipropanolamine, di-isopropanolamine, butanolamine, and mixtures thereof.

6. The composition of claim 1 wherein the acid moiety of the low molecular weight ester is selected from the group consisting of caprylic, caproic, capric and mixtures thereof.

7. The composition of claim 1 wherein the molar ratio of amine to total ester in the reaction mixture is in the range from 8.0 to 2.0.

8. The composition of claim 1 having an amide to ester absorbance ratio in the range of from at least 2.0 as measured by transmission infrared spectroscopy.

9. A method for improving the fuel economy of an engine fuel comprising a major portion of hydrocarbons comprising adding to the mixture of hydrocarbons, a fuel economy improving effective amount of the fuel additive of claim 1.

10. A fuel additive composition obtained by heating a reaction mixture comprising:

a) mixed fatty acid esters selected from the group consisting of tri-esters of fatty acids containing from about 6 to 20 carbon atoms;

b) a mono or di-(hydroxy alkyl amine) or mixtures thereof; and c) a low temperature property enhancing effective amount of a low molecular weight ester having an acid moiety represented by the formula:

$$R''''CO—$$

wherein R'''' is an alkyl or alkenyl hydrocarbon group containing from about 3 to 10 carbon atoms, the amount of each component and the temperature and time period of heating being sufficient to produce an amide to ester absorbance ratio in the composition of at least 2.0 as measured by transmission infrared spectroscopy.

11. The composition of claim 10 wherein the mixed fatty acid esters comprise a glycerol tri-ester.

12. The composition of claim 10 wherein the mixed fatty acid esters are selected from the group consisting babassu oil, palm kernel oil, palm oil, olive, oil, castor oil, peanut oil, rape oil, beef tallow oil, lard oil, whale blubber oil and sunflower oil.

13. The composition of claim 10 wherein the amine has the formula:

$$HN(R'''OH)_{2-a}H_a$$

wherein R''' is a divalent alkylene hydrocarbon group containing 1–10 carbon atoms, and a is 0 or 1.

14. The composition of claim 13 wherein the amine is selected from the group consisting of ethanolamine, diethanolamine, propanolamine, isopropanolamine, dipropanolamine, di-isopropanolamine, butanolamine, and mixtures thereof.

15. The composition claim 10 wherein the acid moiety of the low molecular weight ester is selected from the group consisting of caprylic, caproic, capric and mixtures thereof.

16. The composition of claim 10 wherein the molar ratio of amine to total ester in the reaction mixture is in the range from 8.0 to 2.0.

17. The composition of claim 10 wherein the mixture comprises from about 0.1 to about 0.8 moles of the mixed fatty acid ester, from about 1.0 to about 4.5 moles of amine and from about 0.01 to about 0.60 moles of the low molecular weight ester.

18. The composition of claim 10 wherein the mixture is heated at a temperature of from about 60° C. to about 250° for a time period from about 0.5 to 10 hours.

19. The composition of claim 10 wherein the amount of the fatty acid ester mixture is in the range from about 0.5 to about 0.8 moles.

20. The composition of claim 10 wherein the amount of the low molecular weight ester is in the range from about 0.1 to about 0.5 moles.

21. The composition of claim 10 wherein the amount of amine is in the range from about 1.2 to about 3.2 moles.

22. The composition of claim 10 wherein the mixture is heated for a time period from about 1.5 hours to about 6.0 hours.

23. The composition of claim 10 wherein the mixture is heated at a temperature in the range from about 110° C. to about 180° C.

24. The composition of claim 10 wherein the ratio of amine to total ester content is in the range from about 5.0 to 2.2, the total ester content added being represented by the amount of the mixed fatty acid ester and the amount of the low molecular weight ester.

25. A method for improving the fuel economy of an engine fuel comprising a major portion of hydrocarbons comprising adding to the mixture of hydrocarbons a fuel economy improving effective amount of the fuel additive composition of claim 10.

26. A method for preparing a fuel additive composition comprising the steps of heating a mixture of:

a) mixed fatty acid esters selected from the group consisting of tri-esters of fatty acids containing from about 6 to 20 carbon atoms;

b) a mono or di-(hydroxy alkyl amine) or mixtures thereof; and c) a low temperature property enhancing effective amount of a low molecular weight ester having an acid moiety represented by the formula:

$$R''''CO—$$

wherein R'''' is an alkyl or alkenyl hydrocarbon group containing from about 3 to 10 carbon atoms at a temperature and for a time sufficient to produce a composition having an amide to ester absorbance ratio of at least about 2.0 as measured by transmission infrared spectroscopy, the mixture having a ratio of amine to total ester content in the range from 10.0 to 1.0.

27. The method of claim 26 wherein the mixed fatty ester has an acid moiety having the formula ROOH wherein R is an alkyl hydrocarbon containing 7 to 15 carbon atoms.

28. The method of claim 26 wherein the mixture comprises from about 0.5 to about 0.8 moles of the mixed fatty acid esters, 1.2 to about 3.2 moles of the amino and, from about 0.10 to about 0.50 miles of the low molecular weight ester.

29. The method of claim 27 wherein the mixed fatty ester has an acid moiety having the formula ROO wherein R is an alkyl hydrocarbon containing 7 to 15 carbon atoms.

30. The method of claim 26 wherein the mixed fatty acid esters comprise a glycerol tri-ester.

31. The method of claim 26 wherein the mixed fatty acid esters are selected from the group consisting babassu oil, palm kernel oil, palm oil, olive oil, castor oil, peanut oil, rape oil, beef tallow oil, lard oil, whale blubber oil and sunflower oil.

32. The method of claim 26 wherein the amine has the formula:

$$HN(R'''OH)_{2-a}H_a$$

wherein R''' is a divalent alkylene hydrocarbon group containing 1–10 carbon atoms, and a is 0 or 1.

33. The method of claim 32 wherein the amine is selected from the group consisting of ethanolamine, diethanolamine, propanolamine, isopropanolamine, dipropanolamine, di-isopropanolamine, butanolamine, and mixtures thereof.

34. The method of claim 26 wherein the acid moiety of the low molecular weight ester is selected from the group consisting of caprylic, caproic, capric and mixtures thereof.

35. The method of claim 26 wherein the mixture is heated at a temperature of from about 60° to about 250° for a time period of from about 0.5 to 10 hours.

36. The method of claim 26 wherein the mixture is heated at a temperature of from about 110° C. to about 180° C.

37. The method of claim 26 wherein the mixture is heated for a time period of from about 1.5 to about 6.0 hours.

38. The method of claim 26 wherein the mixed fatty ester has an acid moiety having the formula ROOH wherein R is an alkyl hydrocarbon containing 7 to 15 carbon atoms.

39. A method for preparing a fuel additive composition comprising the steps of heating a mixture of:

a) mixed fatty acid esters selected from the group consisting of tri-esters of fatty acids containing from about 6 to 20 carbon atoms;

b) a mono or di-(hydroxy alkyl amine) or mixtures thereof; and c) a low temperature property enhancing effective amount of a low molecular weight ester having an acid moiety represented by the formula:

$$R''''CO—$$

wherein R'''' is an alkyl or alkenyl hydrocarbon group containing from about 3 to 10 carbon atoms at a temperature and for a time sufficient to produce a composition having an amide to ester absorbance ratio of at least about 2.0 as measured by transmission infrared spectroscopy, the mixture having a ratio of amine to total ester content in the range from 10.0 to 1.0.

40. An engine fuel composition comprising a major portion of a mixture of hydrocarbons and a fuel economy improving effective amount of an engine fuel additive obtained by heating a mixture of:

a) mixed fatty acid esters selected from the group consisting of tri-esters of fatty acids containing from about 6 to 20 carbon atoms;

b) a mono or di-(hydroxy alkyl amine) or mixtures thereof; and c) a low temperature property enhancing effective amount of an ester having an acid moiety represented by the formula:

$$R''''CO—$$

wherein R'''' is an alkyl or alkenyl hydrocarbon group containing from about 3 to 10 carbon atoms at a temperature and for a time sufficient to achieve an amide ester absorbance ratio in the composition in the range of at least about 2.0 as measured by transmission infrared spectroscopy.

* * * * *